US008627967B2

(12) United States Patent
Enghard

(10) Patent No.: US 8,627,967 B2
(45) Date of Patent: Jan. 14, 2014

(54) DRINKING CONTAINER WITH A CLOSURE DEVICE HAVING A RESERVOIR CHAMBER THEREIN

(75) Inventor: Florian Enghard, Frankfurt (DE)

(73) Assignees: Florian Enghard, Frankfurt (DE); Suat Polat, Solms (DE); Armin Enghard, Frankfurt (DE)

( * ) Notice: Subject to any disclaimer, the term of this patent is extended or adjusted under 35 U.S.C. 154(b) by 1086 days.

(21) Appl. No.: 12/083,118

(22) PCT Filed: Sep. 28, 2006

(86) PCT No.: PCT/EP2006/009425
§ 371 (c)(1),
(2), (4) Date: Apr. 4, 2008

(87) PCT Pub. No.: WO2007/039223
PCT Pub. Date: Apr. 12, 2007

(65) Prior Publication Data

US 2009/0223921 A1 Sep. 10, 2009

(30) Foreign Application Priority Data

Oct. 6, 2005 (DE) ..... 10 2005 047 866

(51) Int. Cl.
*B65D 1/02* (2006.01)
*B65D 51/28* (2006.01)

(52) U.S. Cl.
USPC ..... 215/6; 215/227; 215/228; 215/DIG. 8; 206/222; 426/115; 426/519

(58) Field of Classification Search
USPC ..... 215/227, 228, DIG. 8, 6, 211, 356; 206/222, 221; 426/115, 519; 222/145.5
See application file for complete search history.

(56) References Cited

U.S. PATENT DOCUMENTS 1,415,908 A * 5/1922 Tofting ..... 215/231
2,793,776 A 5/1957 Lipari
2,813,649 A 11/1957 Lipari
3,404,811 A * 10/1968 Cernei ..... 222/83

(Continued)

FOREIGN PATENT DOCUMENTS

DE 2 339 388 2/1975
DE 296 20 767 2/1998

(Continued)

OTHER PUBLICATIONS

USPTO Office Action issued on Jul. 29, 2011 in U.S. Appl. No. 12/449,957, 8 total pages.

*Primary Examiner* — Sue A Weaver
(74) *Attorney, Agent, or Firm* — W. F. Fasse

(57) ABSTRACT

A drinking container has an interior space (5) for receiving a drinking liquid (14) and a container opening (4) preferably arranged on the top side of the container, into which a closure device (3) with a receiving chamber (9) is provided. The content of the receiving chamber can be selectively released into the interior space (5). The closure device (3) has an externally threaded upper part (6) and a bottom part (7) as well as connection elements (8) disposed therebetween. The receiving chamber (9) is formed between the upper part and the lower part, and has an introduction opening (22) leading to the interior space. Thus, the content of the receiving chamber (9) is releasable into the interior space by a turning-in process of the closure device. The drinking container is suitable for preparing an unstable mixed drink of creatine powder (13) and an aqueous drinking solution (14).

8 Claims, 2 Drawing Sheets

(56) References Cited

U.S. PATENT DOCUMENTS

| | | | | |
|---|---|---|---|---|
| 3,827,593 | A * | 8/1974 | Kramb et al. | 215/208 |
| 3,924,741 | A | 12/1975 | Kachur et al. | |
| 4,315,570 | A | 2/1982 | Silver et al. | |
| 4,513,861 | A | 4/1985 | Baram | |
| 5,207,341 | A * | 5/1993 | Yeager | 215/334 |
| 5,419,445 | A * | 5/1995 | Kaesemeyer | 215/11.1 |
| 5,462,101 | A * | 10/1995 | Mouchmouchian | 141/364 |
| 5,465,835 | A * | 11/1995 | Schumacher et al. | 206/221 |
| 5,682,931 | A * | 11/1997 | Mouchmouchian | 141/319 |
| 5,794,802 | A | 8/1998 | Caola | |
| 5,967,309 | A | 10/1999 | Robles-Gonzalez et al. | |
| 5,984,141 | A * | 11/1999 | Gibler | 222/80 |
| 6,045,254 | A * | 4/2000 | Inbar et al. | 366/130 |
| 6,068,396 | A | 5/2000 | Baudin | |
| 6,113,257 | A | 9/2000 | Sharon et al. | |
| 6,527,110 | B2 * | 3/2003 | Moscovitz | 206/222 |
| 6,644,471 | B1 | 11/2003 | Anderson | |
| 6,702,161 | B2 * | 3/2004 | Adams et al. | 222/521 |
| 6,766,903 | B1 | 7/2004 | Yehhsu | |
| 6,820,740 | B1 | 11/2004 | Spector | |
| 6,840,373 | B2 * | 1/2005 | Gibler et al. | 206/219 |
| 6,886,686 | B2 | 5/2005 | Anderson | |
| 6,962,254 | B2 | 11/2005 | Spector | |
| 7,055,685 | B1 * | 6/2006 | Patterson et al. | 206/220 |
| 7,083,043 | B2 * | 8/2006 | Sharon | 206/221 |
| 7,172,095 | B2 | 2/2007 | Marshall | |
| 7,503,453 | B2 | 3/2009 | Cronin et al. | |
| 2004/0007481 | A1 * | 1/2004 | Kiser, Jr. | 206/219 |
| 2005/0126632 | A1 | 6/2005 | Farrell et al. | |
| 2005/0150902 | A1 | 7/2005 | Cho | |
| 2006/0118435 | A1 | 6/2006 | Cronin et al. | |
| 2007/0199839 | A1 * | 8/2007 | Sharon et al. | 206/219 |
| 2008/0105639 | A1 * | 5/2008 | Musetti | 215/6 |
| 2009/0321285 | A1 | 12/2009 | Enghard | |
| 2010/0140207 | A1 | 6/2010 | Enghard | |

FOREIGN PATENT DOCUMENTS

| | | |
|---|---|---|
| DE | 298 01 519 | 4/1998 |
| DE | 103 41 112 | 3/2005 |
| DE | 202006009805 | 8/2006 |
| EP | 0 520 616 | 12/1992 |
| GB | 440661 | 1/1936 |
| GB | 477 922 | 1/1938 |
| GB | 1 436 648 | 5/1976 |
| WO | WO 98/29317 | 7/1998 |
| WO | WO 01/25099 | 4/2001 |
| WO | WO 2004/103853 | 12/2004 |
| WO | WO 2006/034162 | 3/2006 |
| WO | WO 2006/097823 | 9/2006 |

* cited by examiner

DRINKING CONTAINER WITH A CLOSURE DEVICE HAVING A RESERVOIR CHAMBER THEREIN

FIELD OF THE INVENTION

The invention relates to a drinking container with a closure device having a reservoir chamber therein, whereby contents of the reservoir chamber can be selectively released into contents of the drinking container when desired.

BACKGROUND INFORMATION

At the present time, there are many nutritional compositions that are to be consumed especially before or during athletic activities. These shall especially serve to improve the performance capability or to supply important nutritional components. These nutritional compositions mostly consist of an aqueous drinking solution and a solid or powder-form nutritional supplement substance, that are admixed with one another and consumed in a drinking container. Especially with regard to isotonic nutritional compositions, there are also already isotonic finished prepared drinks or beverages, for which the beverage bottler has already added the powder-form isotonic supplement substances to an aqueous solution, and which can be consumed on the spot as a finished prepared beverage from a concurrently distributed drinking container.

Such finished prepared beverages in the mixed state often lose taste or effectiveness so that it is necessary to admix one or more nutritional supplement substances into the drinking solution only on location shortly before consumption. For that purpose, the nutritional supplement substances are usually supplied in powder form or as a solid substance in a soluble tablet form and are manually admixed with a potable drinking water or mineral water. This is very complicated or cumbersome especially in connection with athletic activity or at sport-related places of use, and requires separately bringing along a container of potable drinking water, a container with the nutritional supplement substances as well as a separate drinking container for mixing and drinking the prepared beverage.

For several years, there has been a considerable interest especially among athletes, to consume creatine as a nutritional supplement substance. Creatine plays a key roll in the regulation and homeostasis of the energy metabolism of the skeletal musculature. In that regard it is now generally acknowledged that the maintenance of the availability of phosphocreatine is necessary for the continuing generation of muscle power or force. Even though the creatine synthesis takes place in the liver, the kidney, and the pancreas, it has been known for some time that the oral intake of creatine will supplement the creatine supply of the entire body. In that regard it has been found that the intake of 20 to 30 g of creatine per day over several days can give rise to an increase of the total creatine content of the human musculature by more than 20%. Thereby it has been found that an increase of the muscle force or power is achieved already by the administration of creatine in amounts of at least 15 g or 0.2 to 0.4 g/kg of body weight within at least two days. In that regard, creatine is provided in a powder form that is stirred into an aqueous solution on location and is consumed by means of a drinking container. However, creatine in aqueous solutions will be converted in a short time into the related compound creatinine, which no longer has a muscle power increasing effect and is excreted as a waste product with the urine. For that reason it has previously not been achieved successfully, to produce creatine as a finished prepared beverage in a previously prepared drinking container for longer term consumption.

However, containers with a separate storage chamber are already known from the DE 103 41 112 A1, through which a pre-dosed quantity of a nutritional supplement substance can be admixed into an aqueous solution shortly before consumption. For that purpose, a main container for receiving a first substance is provided, which consists of a base surface and a side wall that surrounds the base surface and comprises a container opening at the top thereof. For air-tight closure, a lid or cap element with integrated storage chamber is arranged into the container opening, and which is partially screwed onto the main container over an external threading of the bottle neck. The storage chamber consists of solid insert parts, that comprise a cylinder-shaped sleeve and a closing or sealing cap and are closed at the bottom by a solid tight film. Apparently solid, powder-form or gas-form nutritional supplement substances can be accommodated as a second substance in this storage chamber. Additionally, further a compression body is set into the lid or cap element, and downwardly comprises a cutting blade section, which cuts through the film due to a pressing force from above and thus introduces the second substance into the first substance of the main container, which is then admixable therewith as a finished prepared beverage. Such receiving or storage chambers separated by films are basically only suitable for one-time use, or are again sealable only in a complicated or cumbersome manner, so that this is contrary to a repeated re-use. But even with a one-time use, rest pieces of film can get into the beverage, so that it is sensible to pour-over or transfer this mixture through a sieving process into a separate drinking container.

SUMMARY OF THE INVENTION

In view of the above, it is therefore an underlying object of embodiments of the present invention to provide a drinking container with a cap or closure device by which nutritional supplement substances are admixable with a drinking substance in a short time, and which is simple to handle, and through which absolutely no contaminants can get into the finished prepared drink or beverage.

The above object has been achieved according to an embodiment of the invention directed to a closure device for a drinking container. The drinking container includes a container body that bounds a container inner space adapted to receive a drinking liquid, and an internally threaded container outlet that extends from the container body along an axis and that has an internal threading provided on an inner cylindrical surface of the container outlet. The container outlet bounds a container opening which communicates from an exterior environment into the container inner space. The closure device comprises a reservoir which comprises an imperforate bottom part, an externally threaded upper body and plural connector members. The bottom part is sized and adapted to selectively close and open the container opening respectively by moving along the axis toward and into sealing contact with the container outlet and by moving along the axis away from the container outlet and into the container inner space. The upper body is sized and adapted to fit sealingly and axially movably in the container opening in the container outlet, and has an external threading provided on an outer cylindrical surface thereof, wherein the external threading is adapted to engage with the internal threading of the container outlet. The connector members extend between the upper body and the bottom part and rigidly and fixedly connect the bottom part with the upper body so that the upper body, the connector members and the bottom part are constrained to move together as a unit rotationally about the axis and axially along the axis. A hollow reservoir chamber adapted to receive a beverage supplement substance is defined axially between the upper body and the bottom part. Plural discharge openings are defined respectively circumferentially between successive ones of the connector members and axially between the upper body and the bottom part. The reservoir is configured, constructed and adapted so that a screwing engagement of the external threading of the upper body with the internal threading of the container outlet and a rotation of the unit about the axis, respectively depending on a direction of the rotation, will cause the unit to move axially along the axis respectively selectively in an opening axial direction into the container whereby the bottom part moves away from the container outlet and into the container inner space so as to open the container opening and communicate the reservoir chamber with the container inner space through the discharge openings, and in a closing axial direction out of the container outlet whereby the bottom part moves toward and into the sealing contact with the container outlet so as to close the container opening and seal the reservoir chamber from the container inner space.

The invention has the advantage that even unstable drink or beverage mixtures can be prepared in a simple manner at any time and at any location shortly before the consumption, and can be immediately consumed out of the drinking container, due to the screwable closure device with an integrated receiving chamber for additional nutritional substances. This can be achieved in a simple manner by a simply operable turning or rotating process, without requiring separating walls or separating films to be pierced through with a great application of force.

Such a drinking container also has the advantage that it consists only of a few simple easily-producible parts, that can be produced economically also as synthetic plastic injection molded parts in series production. For that purpose, simply a container bottle with an internal threading and a closure device with an external threading is necessary, whereby advantageously the hollow space of the closure device simultaneously forms the receiving chamber for the nutritional supplement substances, which through an inlet or introduction opening in the bottom part automatically effectuates the emptying into the interior space of the drinking container by a turning or rotating process, and thereby introduces or begins the mixing process.

Also advantageously, no separating substance can be damaged by the invention, so that such a receiving chamber, after the unscrewing or return rotation, is again fillable at any time and thus can be used again by the user himself. Due to the screwing closure, the drinking container can also be quickly disassembled or broken-down into its few component parts through complete screwing out of the closure device, which component parts are then easy to clean for the reuse in an advantageous manner.

In a particular embodiment of the drinking container according to the invention, simultaneously a closeable mouthpiece is arranged on the upper threaded part, through which mouthpiece the drinking liquid can be drunk immediately after the mixing process without further measures, and which also is again useable for the renewed filling-in of a nutritional supplement substance. In that regard it can advantageously involve powder-form, liquid or soluble solid nutritional supplement substances, which can be dosed nearly as desired.

In a further advantageous embodiment, the main container can also be a conventional bottle with an external threading, in which simply an additional adapter with an internal threading and an external threading or a snap-on part is necessary, in order to utilize or insert this closure device.

The inventive drinking container additionally has the advantage that it is exceptionally suited for the preparation of sports drinks, especially for the preparation and utilization of a strength-enhancing unstable drink of creatine and an aqueous solution.

BRIEF DESCRIPTION OF THE DRAWINGS

The invention is explained more closely in connection with an example embodiment, which is shown in the drawing.

DETAILED DESCRIPTION OF EXAMPLE EMBODIMENTS OF THE INVENTION

Figure 1:
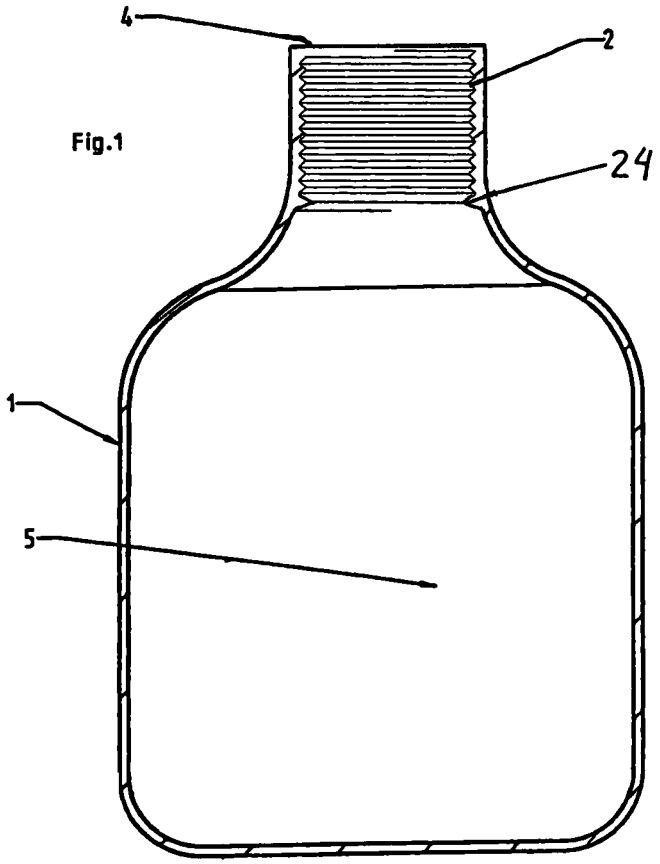
FIG. 1: shows a schematic drinking container without closure device.

A drinking bottle 1 as a particular example of a drinking container is illustrated in FIG. 1 of the drawing. The drinking bottle 1 includes an internal threading 2 for screwing-in a closure device 3. In that regard, the drinking bottle 1 consists of a base surface and a wall surface surrounding the base surface and forming the interior space 5 and comprising a container opening 4 at the top. Such a drinking bottle 1 can consist of a synthetic plastic material or glass or metal preferably aluminum. Because the drinking container 1 preferably shall be used for the admixing of a creatine powder with an aqueous drinking solution, a synthetic plastic bottle is suitable as the drinking container 1 for a one-time use of a pre-dosed quantity of creatine and drinking liquid.

For a reusability, preferably a light aluminum bottle is provided, for which exact and air-tight internal threadings 2 are producible, without additional seal means being necessary therefor. For a good dosability with different creatine quantities from approximately 15 to 30 g, preferably internal threadings 2 with approximately 30 mm clear diameter and approximately 30 mm thread length are provided. In that regard, conventional thread pitches of metric threading embodiments can be selected, which make possible an easily proceeding screwing-in for the filling and for the mixing process. In that regard preferably also conventional bicycle drinking bottles of aluminum can be used, which partially already have internal threadings and are available in advantageous sizes of ⅓ or ½ liter.

Figure 2:
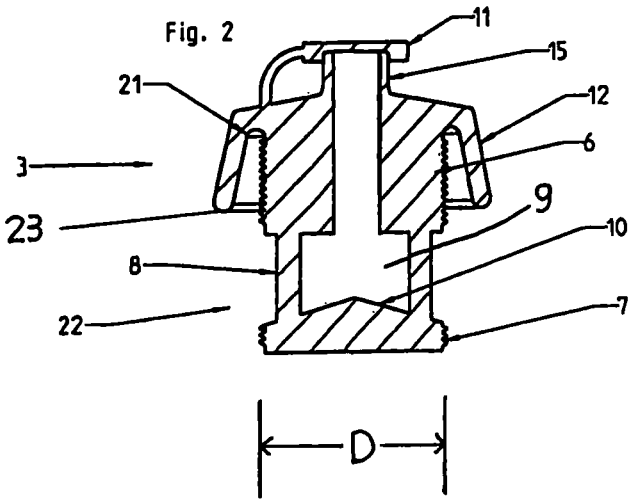
FIG. 2: shows a closure device with a mouthpiece.

A closure device 3 with a mouthpiece 15 that can be screwed into a drinking bottle 1 is illustrated in FIG. 2 of the drawing. This closure device 3 preferably consists of an upper threaded part 6 and a lower threaded part 7 as a cover surface, which are connected with one another by two webs or struts 8 as connection elements. In the screwed-in state, the hollow space 9 between the two threaded parts 6, 7 forms the receiving chamber, into which preferably the creatine powder as the nutritional supplement substance is introduced. In that regard, the lower threaded part 7 is still further equipped with a ball- or conical-type protrusion or elevation 10, which shall ensure a complete emptying into the interior space 5 of the drinking bottle 1.

The upper threaded part 6 is additionally still provided with a mouthpiece 15, which is closeable by a cap 11 and forms an opening to the receiving chamber 9. For improving the ability to be screwed-in, the upper threaded part 6 is provided with an outwardly flaring or collared screw-in head 12, with a collar that surrounds the external threading of the upper threaded part 6, and that is spaced from the upper threaded part 6 by an annular or ring-shaped contact rim 21. The spacing distance of the collar from the external threading corresponds at least to the thickness of the bottle neck. The ring-shaped contact rim 21 of the screw-in head 12 further serves for limiting the screw-in depth. Furthermore, the height of the cylindrical or circumferential collar, and the position of the bottom edge rim 23 thereof, can also serve as a mark for the minimum screwing-in depth that is necessary in order that the lower threaded part 7 still sealingly engages into the internal threading 2 of the bottle neck or throat. The closure device 3 is preferably produced as a synthetic plastic injection molded part, whereby both external threadings of the two threaded parts 6, 7 comprise the same diameter D and the same pitch as the internal threading 2 of the drinking bottle 1.

In a simplified embodiment the connection elements 8 can also be embodied as vertical threaded surfaces or threaded studs, which simply must comprise an inlet or introduction opening 22 outwardly to the drinking bottle interior space 5 in the area of the lower threaded part 7. The threaded parts 6, 7 are embodied in such a manner that they contact sealingly on the internal threading 2 of the drinking bottle 1. However, encircling or circumferentially running seal grooves can also be provided on the threaded parts 6, 7, into which grooves for example additional O-ring seals of rubber or other seal materials are inserted. For better sealing, the threaded parts 6, 7 can also be provided with a Teflon seal layer, which seals-off in an air-tight manner both the content 5 of the drinking bottle 1 from the content of the receiving chamber 9, as well as the receiving chamber 9 from the outside area.

Figure 3:
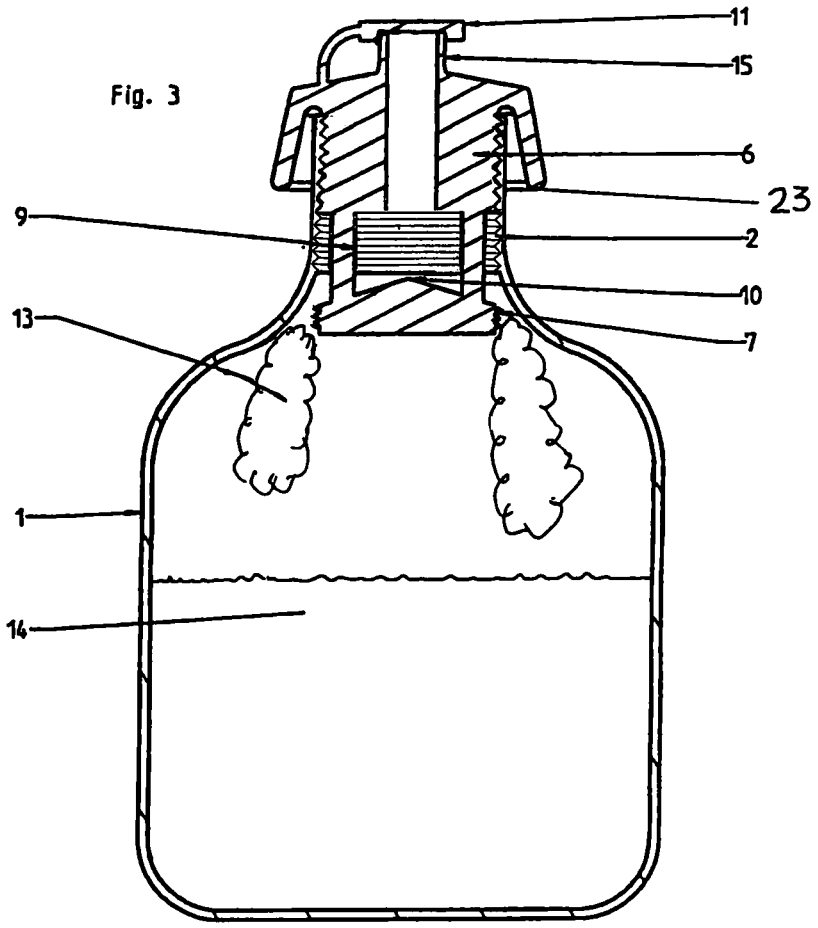
FIG. 3: shows a drinking container with a screwed-in closure device.

A drinking container embodied as a drinking bottle 1 and a closure device 3 is illustrated in FIG. 3 of the drawing, whereby the closure device 3 is screwed-in so far that the creatine 13 is dosed out of the receiving chamber 9 into the aqueous drinking solution 14 of the drinking bottle 1. In that regard, before the insertion of the closure device 3, the aqueous drinking solution 14 was already filled into the drinking bottle 1 in the provided quantity of preferably ⅓ liter. This aqueous drinking solution 14 preferably consists of drinking water or mineral water and flavoring agents that advantageously are superimposed over the taste of the creatine. Thereafter the closure device 3 is screwed into the internal threading 2 of the drinking bottle 1. Before the admixing, first the creatine 13 is introduced into the receiving chamber 9, preferably through the mouthpiece 15. For that purpose, the closure device 3 is first only screwed-in so far that the lower threaded part 7 still engages into the internal threading 2 of the drinking bottle 1. For fixing this screwed-in position, a slight narrowing 24 is provided on the lower thread course of the internal threading 2, which causes a noticeable difficulty in proceeding further. It is, however, also possible to provide a screw-in marking on the upper threaded part 6, which makes an axial screw-in depth recognizable. For this purpose, preferably the screw-in head 12 is extended so far downwardly to its bottom edge rim 23 so that it forms a plane with the top surface of the bottle neck or throat opening upon reaching the permissible screw-in depth.

With regard to a drink or beverage that is pre-filled in the production plant, preferably a daily dose of 15 g per person is filled into the receiving chamber 9 and the mouthpiece 15 is closed by a closure cap 11 or a closure plug. When needed, the outer ring of the screw-in head 12 is then screwed-in via the upper threaded part 6 so far until it contacts or lies on the upper drinking bottle rim, whereby then at least the introduction opening 22 of the receiving chamber 9 to the interior space 5 is opened, and thereby the creatine falls into the drinking solution 14 due to the effect of gravity. Thereafter, for improved homogeneous mixing, the drinking container is shaken, and thereby the mixed drink of creatine and the aqueous solution is available for consumption. For that purpose the closure cap 11 can then be removed so that the homogeneously mixed drinking liquid is then available for drinking directly out of the mouthpiece 15.

Figure 4:
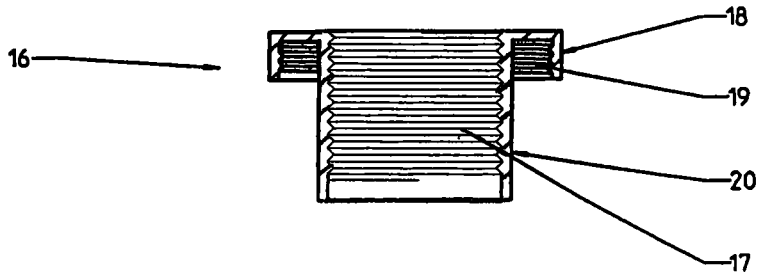
FIG. 4: shown an adapter piece for drinking bottles with external threading.

In so far as such a closure device 3 is, however, to be secured on a conventional glass bottle with an external threading, a rounded rim for snapping on a seal closure, or with an internal pressing connection, an adapter piece 16 can be provided, as is illustrated in FIG. 4 of the drawing for a drinking bottle with external threading. This adapter piece 16 consists of a cylindrical continuous inner part 20, in which an internal threading 17 for receiving the closure device 3 is provided, and that is preferably embodied as a synthetic plastic or metal injection molded part. Coaxial thereto, an outwardly flaring or collared rim part 18 is secured at the top, and the rim part comprises an enlarged internal threading 19 parallel to the internal threading 17, whereby the enlarged internal threading 19 engages into the external threading of the drinking bottle to be utilized. Instead of the enlarged internal threading 19, such an adapter piece 16, can also comprise a snap closure or snap rim that can be set onto typical bottles with a round rim for crown cork caps. Such an adapter piece 16 can, however, also be embodied so that it can be glued or welded into other glass or synthetic plastic containers. In a different embodiment the adapter piece can also be fixed simply by a press-on force in the bottle neck or throat, whereby the outwardly flaring rim part can be omitted.

The invention claimed is:

1. A closure device for a drinking container, wherein the drinking container includes a container body that bounds therein a container inner space adapted to receive therein a drinking liquid, and an internally threaded container outlet that extends from the container body along an axis and that has an internal threading provided on an inner cylindrical surface of the container outlet which bounds therein a container opening which communicates from an exterior environment into the container inner space;

wherein said closure device comprises a reservoir which comprises:

an imperforate bottom part that is sized and adapted to selectively close and open the container opening respectively by moving along the axis toward and into sealing contact with the container outlet and by moving along the axis away from the container outlet and into the container inner space;

an externally threaded upper body that is sized and adapted to fit axially movably in the container opening in the container outlet, and that has an external threading provided on an outer cylindrical surface thereof, wherein said external threading is adapted to engage with the internal threading of the container outlet; and plural connector members that extend between said upper body and said bottom part and that rigidly and fixedly connect said bottom part with said upper body so that said upper body, said connector members and said bottom part are constrained to move together as a reservoir unit rotationally about the axis and axially along the axis, wherein a hollow reservoir chamber adapted to receive a beverage supplement substance is formed at least in a space axially between said upper body and said bottom part, and plural discharge openings are defined respectively circumferentially between successive ones of said connector members and axially between said upper body and said bottom part;

wherein said closure device further comprises a circumferential collar extending circumferentially around said upper body and sized to fit externally circumferentially around at least a portion of the container outlet, and an annular rim that extends annularly from said upper body and connects said circumferential collar with said upper body; and wherein said reservoir is configured, constructed and adapted so that a screwing engagement of said external threading of said upper body with the internal threading of the container outlet and a rotation of said reservoir unit about the axis, respectively depending on a direction of the rotation, will cause said reservoir unit to move axially along the axis respectively selectively:

in an opening axial direction into the container inner space whereby said bottom part moves away from the container outlet and into the container inner space so as to open the container opening and communicate said reservoir chamber with the container inner space through said discharge openings, and in a closing axial direction out of the container inner space whereby said bottom part moves toward and into the sealing contact with the container outlet so as to close the container opening and seal said reservoir chamber from the container inner space.

2. The closure device according to claim 1, wherein said annular rim rigidly and fixedly connects said circumferential collar with said upper body, wherein said annular rim and said circumferential collar are also parts of said reservoir unit.

3. The closure device according to claim 2, wherein said circumferential collar, said annular rim, said upper body, said connector members and said bottom part are integrally formed together with one another to form said reservoir unit as a one-piece monolithic reservoir unit.

4. The closure device according to claim 1, wherein said annular rim is configured and arranged to limit a range of axial motion of said reservoir along the axis into the container outlet due to said annular rim contacting a rim of the container outlet.

5. A combination comprising said closure device according to claim 1 together with said drinking container, wherein said container outlet is a container neck that is permanently fixedly connected to said container body as one piece, and said container opening has a diameter smaller than said container inner space.

6. A combination comprising said closure device according to claim 1 together with said drinking container, wherein said container body includes a container outlet shell, said container outlet comprises an adapter piece including a cylindrical sleeve that forms said inner cylindrical surface of said container outlet having said internal threading of said container outlet provided thereon, and said adapter piece further includes an adapter collar that extends circumferentially around said container outlet shell, wherein an inner circumferential surface of said adapter collar has a connection structure provided thereon, and wherein said connection structure is releasably engaged with a mating configuration on an outer circumferential surface of said container outlet shell.

7. The combination according to claim 6, wherein said adapter piece including said cylindrical sleeve and said adapter collar is a one-piece component of a material selected from the group consisting of plastic and metal, and said container outlet shell is a fixed integral part of said container body.

8. The combination according to claim 6, wherein said mating configuration on said outer circumferential surface of said container outlet shell of said container body is a second external threading, and said connection structure on said inner circumferential surface of said adapter collar is a second internal threading that mates with said second external threading.

* * * * *